United States Patent [19]

Sassak

[11] Patent Number: 4,997,060

[45] Date of Patent: Mar. 5, 1991

[54] APPARATUS FOR CONTROLLING THE DESCENT OF A PASSENGER CARRYING BODY

[76] Inventor: John J. Sassak, 36855 Schoolcraft, Livonia, Mich. 48150

[21] Appl. No.: 488,267

[22] Filed: Mar. 5, 1990

[51] Int. Cl.[5] ..... A62B 1/02

[52] U.S. Cl. ..... 182/48; 272/6

[58] Field of Search ..... 182/48, 49; 272/6

[56] References Cited

U.S. PATENT DOCUMENTS

| | | | |
|---|---|---|---|
| 817,381 | 4/1906 | Matson | 91/1 |
| 2,229,201 | 1/1941 | Williford et al. | 272/6 |
| 3,497,159 | 2/1970 | Lancsa | 182/48 |
| 4,037,685 | 7/1977 | Talucci | 182/48 |
| 4,122,934 | 10/1978 | Nieto de Moreno | 193/32 |
| 4,350,224 | 9/1982 | Jochum et al. | 182/82 |
| 4,372,423 | 2/1983 | Pelley | 182/3 |
| 4,487,410 | 12/1984 | Sassak | 272/6 |
| 4,545,574 | 10/1985 | Sassak | 272/6 |
| 4,580,659 | 4/1986 | Baker | 182/49 |

*Primary Examiner*—Reinaldo P. Machado
*Attorney, Agent, or Firm*—Charles W. Chandler

[57] ABSTRACT

Apparatus for lowering a passenger-carrying gondola from a high-rise building includes a vertical shaft or chute having a vent opening at its upper end, a vent opening at its lower end, and an air motor at its lower end suitable for either delivering air into or removing air from the chute. A passenger-carrying gondola is mounted in the chute such that as it descends under the influence of gravity, it compresses the air beneath the gondola to a pressure depending upon the position of the lower vent. If the lower vent is totally closed, the gondola creates an air cushion which can be controlled to slowly lower the gondola. The descent of the gondola can be retarded by closing the upper vent to create a vacuum above the gondola. When the gondola is descending from a relatively high-rise position, the air motor can be activated to remove the air cushion beneath the gondola so that it descends at a rate greater than a free-fall. As it approaches the bottom of the chute, the lower vent is closed and the motor de-energized so that the gondola gradually settles on an air cushion. The motor can be reversed to introduce air beneath the gondola to raise it in the shaft.

16 Claims, 2 Drawing Sheets

APPARATUS FOR CONTROLLING THE DESCENT OF A PASSENGER CARRYING BODY

BACKGROUND OF THE INVENTION

This invention is related to a passenger carrying body, such as a gondola, having a controlled rate of descent and means for increasing the rate of descent by removing the air beneath the gondola, during a portion of its descent. For example, a fire escape apparatus must be able to safely but quickly lower the occupants of a building.

High-rise buildings present a problem for removing occupants when a fire occurs in a building. Fire trucks having extendible ladders can remove tenants from only limited heights. Occupants are normally warned not to use elevator shafts during a fire because of the draft and smoke. Further, cable-suspended elevators are limited in height, are slow, and may be unsafe, for example, if the elevator should be disabled.

Some mechanical rescue systems for multi-floor buildings have been disclosed, however, they have limited utility. For example, such a system is illustrated in U.S. Pat. No. 4,350,224 which issued to Sept. 21, 1982 to Freidrich Jochum, Ernst Landsberg, and Plano Zschernack.

Some massive skyscrapers are contemplated for the future. For example, a 500 story skyscraper is being considered in Tokyo. The time for removing an occupant from the to or even intermediate heights either by a mechanical escape device or an elevator would be substantial and most likely ineffective.

My prior U.S. tates Pat. No. 4,545,574 which issued Oct. 8, 1985 and U.S. Pat. No. 4,487,410 which issued Dec. 11, 1984 issued to John J. Sassak disclosed a vertical shaft with a spherical, passenger-carrying gondola that could be raised to various heights by raising the air pressure beneath the gondola using a turbine mounted at the base of the shaft. One advantage of commercial versions of such an arrangement is that it is relatively safe because as the gondola descends in the shaft, it compresses the air to form a cushion. The turbine also provides means for raising the gondola to a desired height.

U.S. Pat. No. 817,381 which issued Apr. 10, 1906 to Charles I. Matson discloses a gondola mounted on a piston. The piston is supported in a vertical shaft, and raised and lowered by compressed air. The gondola is lowered until the piston cuts-off the escape of air from the shaft through a conduit at which time the confined air below the piston acts as a spring or cushion to gradually retard its motion and bring it to a full stop.

U.S. Pat. No. 4,122,934 which issued Oct. 31, 1978 to Pierre A. Nieto de Moreno discloses apparatus for decelerating a body descending body through a tubular shaft. The shaft has an extensible shaft wall filled with pressurized fluid. The fluid pressure is regulated to apply a retarding force on the descending body.

U.S. Pat. No. 2,229,201 which issued Jan. 21, 1941 to M. E. Williford, et al. discloses another gondola which descends through a shaft by gravity for a certain distance, and then is accelerated at a greater rate during a portion of its descent.

Solenoid coils are employed for increasing the rate of descent of the gondola so that it travels with an acceleration greater than that of gravity. The coils would only be effective when the car is within the range of its magnetic force.

A simple fire escape chute is illustrated in U.S. Pat. No. 4,580,659 which issued Apr. 8, 1986 to Ralph T. Baker.

SUMMARY OF THE INVENTION

The broad purpose of the present invention is to provide a pneumatic device which in one form provides a fire escape chute for a high-rise structure. The chute is attached to the side of the structure. Several chutes can be employed, each rising to a different height.

The chute has an air vent at its upper end, an air vent at its lower end, and an air motor. A gondola is mounted in the chute with an opening for receiving a passenger.

The gondola's rate of descent is controlled by opening the vent at the top of the chute, and energizing the air motor to remove the air beneath the gondola at a rate greater than it is being compressed by the descending gondola. This creates a vacuum-like effect beneath the gondola such that it descends at a rate greater than that produced solely by the influence of gravity. As the gondola approaches the chute's bottom, the air motor can be reversed to increase the pressure beneath the gondola so that it slows as it approaches its terminal position.

The invention can also be employed as an elevator for either raising or lowering the gondola, for example, by energizing the air motor to increase the pressure beneath the gondola to raise it to a selected height.

Various devices can be employed for braking the gondola, either to assist the air motor or should the air motor fail. For example, the top vent can be closed to create a vacuum-like effect above the gondola, retarding its descent.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
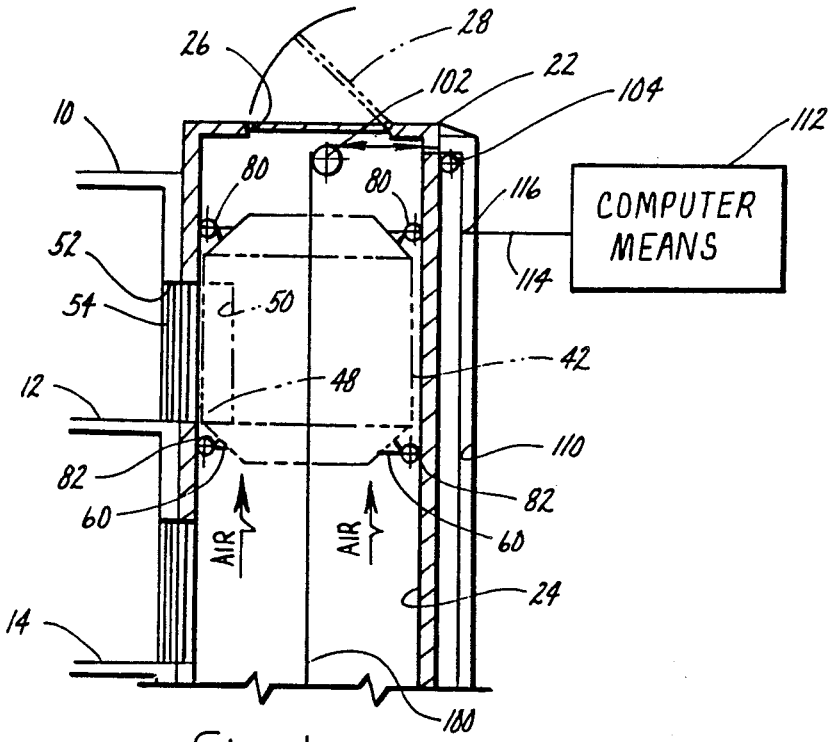
FIG. 1 is a view of the upper end of a chute attached to a building, and illustrating the preferred embodiment of the invention.

Referring to the drawings, FIG. 1 illustrates a high-rise building 10 having several floors 12, 14, 16, 18 and 20.

Chute structure 22 having a generally air-impervious wall is attached to building 10. Structure 22 has a generally vertical shaft or chute 24 accommodating any inclination in the exterior wall of building 10. Structure 22 has a vent opening 26 at the upper end of the chute. A closure means 28 is mounted on the structure for opening or closing vent opening 26. Although closure 28 is illustrated in the form of a door, it could comprise a series of louvers which may be opened or closed.

Similarly, the lower end of structure 22 has a vent opening 30 with closure means 32 for opening and closing opening 30. The lower end of the structure also has a second opening 34. Air motor 36 has a duct 38 disposed in opening 34 for either delivering air into the bottom of the chute or for removing air from the chute. The air motor may be a reversible turbine.

When the top and bottom vents of the chute are closed they form an air-tight structure.

A gondola 40 is mounted in the chute. The gondola has a somewhat cylindrical body 42, a base 44 attached to the lower end of the body, and a cap 46 attached to the body to form an enclosed structure. The gondola has a sliding door 48 which opens or closes opening 50 for either receiving or discharging passengers.

The gondola is usually supported in a position in which opening 50 registers, for example, with an opening 52 in the building. The building may have a suitable air-tight shaft door 54. Sliding door 48 is a sliding door which closes to form an air-tight gondola structure.

Figure 3:
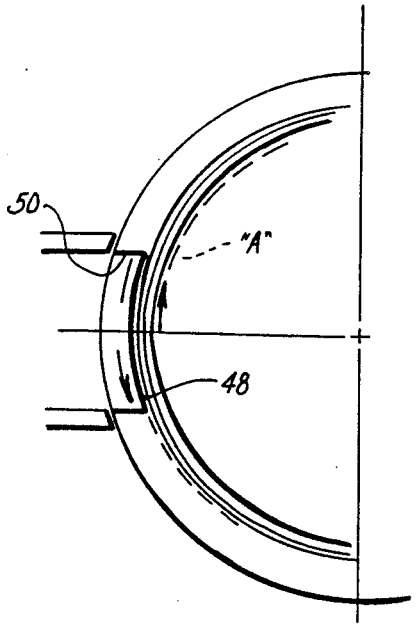
FIG. 3 is a sectional view illustrating a sliding door arrangement for closing the gondola.
Figure 5:
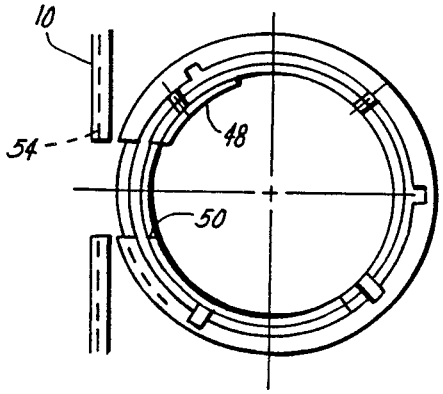
FIG. 5 is a view as seen along 5—5 of FIG. 2.

FIG. 5 illustrates sliding door 48 in its open position for permitting access through opening 50. FIG. 5 also illustrates shaft door 54 in its opened position. FIG. 3 illustrates sliding door 48 in its closed position, with the open position illustrated in dashed lines at "A". Sliding door 48 can also be formed into two halves which open toward opposite sides of the opening 50.

Figure 4:
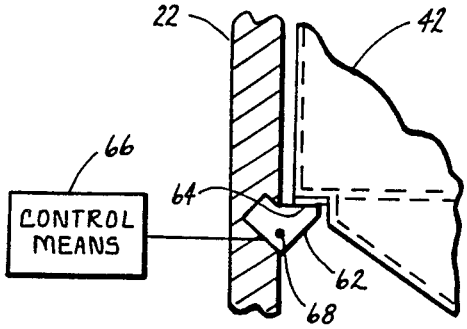
FIG. 4 is a view of moveable feet for supporting the gondola at one of the building's floors.

Retractable feet means 60 are mounted at each floor where the gondola is to be positioned for receiving a passenger, such as is illustrated at FIG. 1. Referring to FIG. 4, a typical foot 62 is illustrated in its extended position to engage a recess 64 adjacent the bottom periphery of the gondola. Several feet cooperate to support the weight of the gondola and its passenger load. Control means 66 provide means for pivoting the foot about a pivot means 68 so that it swings into the wall of the shaft to release the gondola to permit it to fall. The feet supporting the gondola are simultaneously retracted when the gondola is being released.

Figure 6:
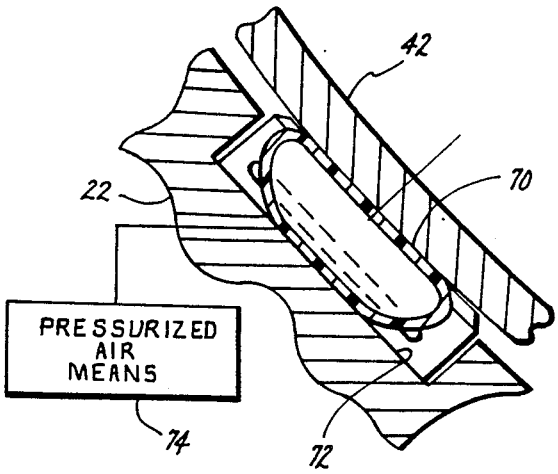
FIG. 6 is a view of an inflatable braking device for the gondola.

Various brake means may be employed for retarding the descent of the gondola. For example, an expandable bladder 70 is illustrated in FIG. 6, mounted in a recess 72 in the shaft wall. Pressurized air means 74 are employed for inflating bladder 70 to form a sliding engagement with the gondola wall. Preferably, the bladder has a neoprene inner tube and a polyester cover and is adapted to take a relatively high operating pressure such as 250 p.s.i.

Figure 7:
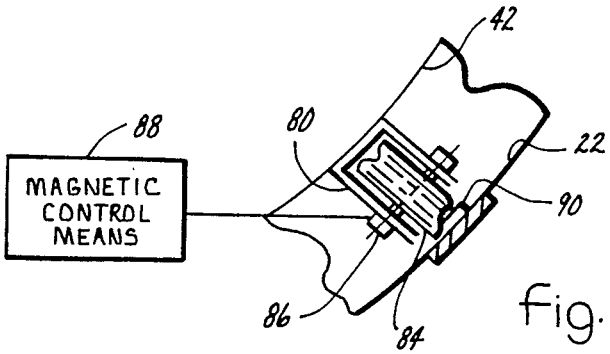
FIG. 7 is a view of a magnetic braking device controlling the gondola's descent.

Magnetic brake means 80 and 82, mounted at the top and bottom of the gondola, respectively can also be employed for braking the descent of the gondola. The magnetic brake means are illustrated in FIGS. 1 and 7 in a position in which they engage the sidewalls of the chute and are illustrated in a retracted position in FIG. 2, permitting the gondola to free-fall down the chute. A typical magnetic brake means is illustrated in FIG. 7, comprises a wheel 84 mounted on a retractable spindle 86. An electromagnetic control means 88 is connected to the wheel for stopping its rotation in order to apply a frictional braking force against a vertical pad 90 mounted in the chute wall.

Figure 2:
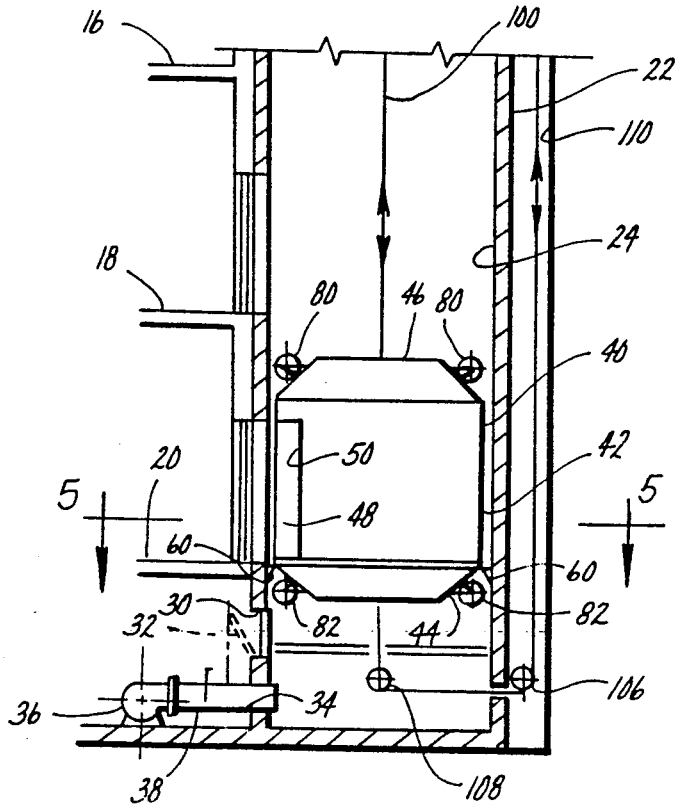
FIG. 2 is a view of a gondola seated at the lower end of the chute.

Referring to FIG. 2, a steel safety cable 100 has one end connected to the top of the gondola, and its opposite end connected to the bottom of the gondola. The cable is mounted around a series of pulley means 102, 104, 106 and 108 such that a part of the cable is disposed in a vertical cable shaft 110. Computer means 112 is connected by sensing means 114 for determining the position of the gondola in the chute with respect to a cable reference position 116.

For illustrative purposes, the cable shaft has incremental marks which are counted by the computer means to determine the instantaneous position of the gondola as it approaches either a selected floor or the loading position at the bottom of the shaft. Computer means 112, in turn is operatively connected to the various controls for operating the air motor, top vent closure 28 and bottom vent closure 32. The computer means may be controlled from inside the gondola so that the passengers can control the ascent or descent of the gondola.

Cable 100 is sufficiently strong to function as a safety cable in case all of the brakes fail.

The gondola can be employed as an escape means and mounted adjacent the roof or any selected floor of a building to safely carry passengers to the bottom of the chute, or it can be employed as an elevator for either raising or lowering passengers with respect to the building.

In operation, when the passengers have been loaded in the gondola and the sliding door closed, the passengers then operate the computer means to permit the gondola to descend. If it has to descend a substantial distance, top closure 28 would be opened, and air motor 36 energized to reduce the pressure beneath the descending gondola beneath the pressure above the gondola to increase the speed of the gondola over that of a free-falling body. As the gondola approaches the chute bottom, the air motor then is de-energized and closure 32 closed to show the gondola's descent to a cushioned stop.

After the passengers have been unloaded, the air motor can be reversed to deliver pressurized air beneath the gondola after closure 32 has been closed, thereby raising the gondola to the top floor 12 for example where brake means 80 are employed to lock the gondola in position until it has received a new load.

Having described my invention, I claim:

1. Apparatus for controlling the descent of a passenger carrying body, comprising:

chute means including a wall having an upper end and a lower end;

a passenger-carrying body disposed in the chute for falling therethrough under the influence of gravity toward the lower end of the chute at a first rate of descent;

first means for closing the chute means below the passenger-carrying body such that the falling body compresses the air beneath the passenger-carrying body to form a cushion;

means for increasing the speed of the passenger-carrying body during a part of its descent toward the lower end of the chute, comprising:

an opening in the chute below the passenger-carrying body for passing air from the chute;

air motor means in said opening for removing air from beneath the passenger-carrying body as it is descending to increase the speed thereof greater than said first rate of descent.

2. An apparatus as defined in claim 1, in which the chute defines a vertical shaft.

3. An apparatus as defined in claim 1, in which the air pump means is reversible to either deliver air into the chute to increase the pressure therein beneath the passenger carrying body, or to remove air from the chute beneath the passenger carrying body for reducing the pressure therein.

4. An apparatus as defined in claim 1, including brake means mounted on the passenger-carrying body and engageable with the chute wall for controlling the descent thereof.

5. An apparatus as defined in claim 1, including an inflatable brake member disposed between the passenger-carrying body and the chute wall for controlling the descent of the passenger-carrying body.

6. An apparatus as defined in claim 4, including structure at the upper end of the chute above the passenger-carrying body, and vent means in such structure, and a closure member for opening such vent means to permit the passage of air therethrough as the passenger-carrying body is descending, or for blocking the vent means to reduce the pressure above the passenger-carrying body as it is descending so as to retard the descent thereof.

7. An apparatus as defined in claim 4, including mechanical brake means mounted between the passenger-carrying body and the chute wall for retarding the descent of the passenger-carrying body.

8. An apparatus as defined in claim 1, in which the chute has a bottom vent which may be closed to increase the pressure beneath the chute as the passenger-carrying body is being descended to retard the descent thereof.

9. An apparatus as defined in claim 1, including pulley means mounted in the chute above the passenger-carrying body, and safety cable means mounted on the pulley means and connected to the passenger carrying body.

10. An apparatus as defined in claim 1, including a cable means having one end connected to the passenger carrying body and an opposite end connected to the chute the cable means having indicia therealong, and computer means for reading the indicia on the cable means to determine the vertical location of the passenger-carrying body in the chute means according to the length of cable that has passed a reference position.

11. An apparatus as defined in claim 10, in which the chute means is adapted to be attached to a multi-story building for transferring a passenger from an upper level in the building toward a lower level thereof.

12. An apparatus as defined in claim 11, including foot means mounted in the chute so as to be moveable between an extended position in which the foot means is disposed to support the passenger-carrying body, and a retracted position in which the foot means is disposed in a position to allow passage of the passenger-carrying body through the chute.

13. An apparatus as defined in claim 1, in which the chute means is adapted to be attached to a building for removing passengers from an upper level thereof, and the chute is a vertical chute.

14. An apparatus as defined in claim 1, including a building having an opening for discharging a building occupant, and the passenger-carrying body has a passenger-receiving opening aligned with the opening in the building, and including sliding door means for closing the passenger-carrying body opening.

15. Apparatus for controlling the descent of a passenger carrying body comprising:

chute means having an upper end and a lower end;

a passenger-carrying body disposed in the chute means for falling therethrough under the influence of gravity toward the lower end of the chute at a first rate of descent; and first means for closing the chute means above the passenger-carrying body to reduce the air pressure above the passenger-carrying body to retard the rate of descent thereof.

16. An apparatus as defined in claim 15, in which the passenger-carrying body comprises a gondola having a bottom, sidewalls attached to the bottom and a cap mounted on the sidewalls to form a closed container for the passengers.

* * * * *